US010293984B2

(12) United States Patent
Tseng et al.

(10) Patent No.: US 10,293,984 B2
(45) Date of Patent: May 21, 2019

(54) PLASTIC BAG WITH SEALABLE SLIDABLE ZIPPER

(71) Applicant: Inteplast Group, Ltd., Livingston, NJ (US)

(72) Inventors: Ben Tseng, East Brunswick, NJ (US); Kelvin Yang, Madison, NJ (US); Jyh-yao Raphael Li, Parsippany, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 12 days.

(21) Appl. No.: 14/812,571

(22) Filed: Jul. 29, 2015

(65) Prior Publication Data

US 2016/0031609 A1 Feb. 4, 2016

Related U.S. Application Data

(60) Provisional application No. 62/031,652, filed on Jul. 31, 2014.

(51) Int. Cl.
*B65D 33/25* (2006.01)

(52) U.S. Cl.
CPC ..... *B65D 33/2591* (2013.01); *B65D 33/25* (2013.01)

(58) Field of Classification Search
CPC ..... B65D 33/25; B65D 33/2508; B65D 33/2516; B65D 33/2525; B65D 33/2533; B65D 33/2541; B65D 33/255; B65D 33/2558; B65D 33/2566; B65D 33/2591
USPC ..... 383/61.1, 63–65
See application file for complete search history.

(56) References Cited

U.S. PATENT DOCUMENTS

| | | | | |
|---|---|---|---|---|
| 3,440,696 | A * | 4/1969 | Staller | B29C 47/128 24/586.1 |
| 4,892,414 | A | 1/1990 | Ausnit | |
| 5,351,369 | A | 10/1994 | Swain | |
| 5,689,866 | A | 11/1997 | Kasai et al. | |
| 5,722,128 | A | 3/1998 | Toney et al. | |
| 6,854,886 | B2 | 2/2005 | Piechocki et al. | |
| 7,610,662 | B2 * | 11/2009 | Ausnit | B65D 33/2591 24/30.5 R |
| 8,196,269 | B2 | 6/2012 | Dais et al. | |
| 2006/0120630 | A9 * | 6/2006 | Ausnit | B65D 33/2591 383/64 |
| 2012/0036684 | A1 * | 2/2012 | Tilman | B65D 33/2541 24/399 |

(Continued)

*Primary Examiner* — Jes F Pascua
*Assistant Examiner* — Nina K Attel
(74) *Attorney, Agent, or Firm* — Stinson Leonard Street LLP

(57) ABSTRACT

A plastic bag having a zipper-type closure which includes opposing closure members which each has a plurality of projections. The projections of the closure members are configured for interlocking and sealing engagement when the zipper is closed. At least one of the projections on one of the closure members is in one embodiment made of a softer material than at least one of the other projections. In some embodiments, the soft projection(s) are not configured for close tolerance fit with complementary mating projections. In some embodiments, the closure is used in combination with a slider. The closure can include deformations for providing tactile or audible feedback against movement of the slider. The closure can include slider rails at a top edge margin to minimize the size of the slider.

15 Claims, 8 Drawing Sheets

(56) References Cited

U.S. PATENT DOCUMENTS

| | | | | |
|---|---|---|---|---|
| 2013/0287322 | A1 | 10/2013 | Gong | |
| 2013/0318752 | A1* | 12/2013 | Kheil | B65D 33/2541<br>24/585.12 |

* cited by examiner

PLASTIC BAG WITH SEALABLE SLIDABLE ZIPPER

FIELD OF THE INVENTION

The present invention relates to plastic bags for storage such as food and other storage bags having a zipper-type closure.

BACKGROUND

Plastic storage bags having zipper-type closures are known in the art and generally provide adequate closing function but do not provide especially good sealing. The rigid material used in the extrusion of the closures and the limitations on extruding tight tolerances in small plastic cross sections are not conducive to forming a hermetic seal.

U.S. Pat. No. 5,351,369 discloses a soft, compressible material extruded along the hooks and grooves of a closure to form a gasket. However, there is a limit on how much a material can reasonably compress. If there is too much material, then the closure won't close. If there is not enough material, the hermetic seal is not achieved. There is therefore very little tolerance for manufacturing variations. This presents challenges in that dimensions vary in production, which may prevent proper closure and sealing for a closure that requires such a precise fit. Gasket type closures are also seen in U.S. Pat. Nos. 4,892,414 and 8,196,269, in which a gasket film is pinched within closure profiles.

U.S. Pat. No. 5,689,866 discloses a hermetic seal created from a pressing rib that is fitted in between two hooks. This design has limitations in that when trying to fit the pressing rib in between the two hooks, there would be resistance forcing the pressing rib out. If the components are not strictly dimensionally controlled, the seal may not form correctly or the closure may not close due to the resistance force.

U.S. Pat. No. 6,854,886 discloses a watertight closure formed by having two collapsible members that press against each other when closed. In one embodiment, the collapsible member is made of a different material and the opposing member is not collapsible. This design has significant dimensional and compressibility limitations. There is only so much a material can reasonably compress. If there is too much material, the closure will not close. If there is not enough material, the seal may be inadequate.

SUMMARY OF THE INVENTION

It is therefore an object of this invention to provide a plastic bag with a zipper-type closure which provides a moisture resistant seal and overcomes the manufacturing limitations of prior attempts.

Briefly, therefore, the invention is directed to a plastic bag with a zipper-type closure having multiple sealing projections and closure projections wherein at least one of the sealing or closure projections is extruded from a plastic material which is different from and softer than a plastic material from which the other projections are extruded.

Other objects and features will be in part apparent and in part pointed out hereinafter.

BRIEF DESCRIPTION OF THE DRAWINGS

Corresponding features are given corresponding reference numerals throughout the drawings.

DETAILED DESCRIPTION OF PREFERRED EMBODIMENTS

Figure 1:
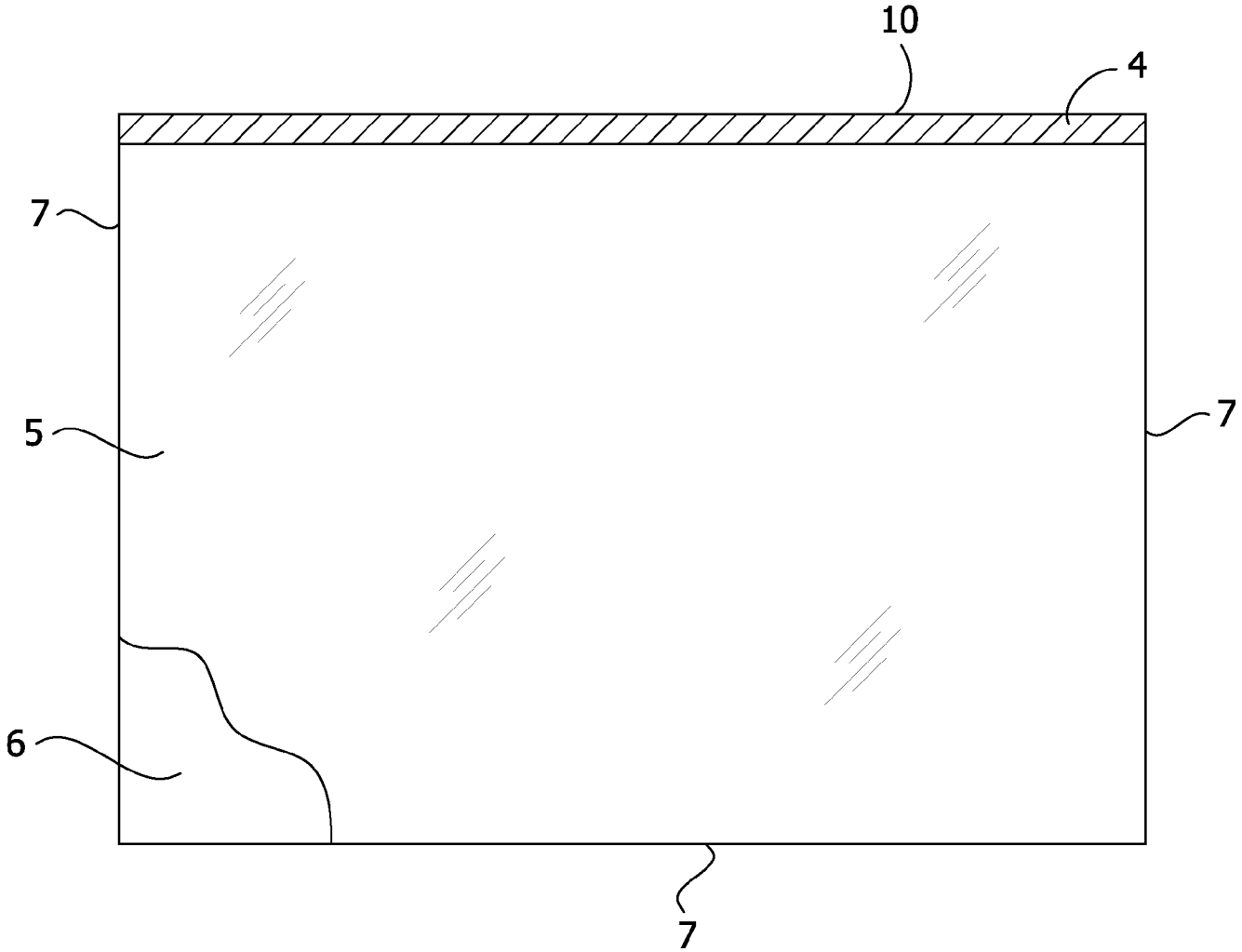
FIG. 1 is a schematic fragmentary elevation of a bag.

The invention is directed to a plastic bag which comprises two abutting flat panels having an opening at one edge and sealed along other edges, such as two rectangular panels sealed along three edges with an opening at the fourth edge. In one preferred embodiment, there is a first panel and a second panel, wherein the first panel and second panel define a bag interior and an opening at an end margin of the first and second panels to permit access to the bag interior. These are shown in the front view in FIG. 1 as two rectangular panels 5, 6, sealed along three edges 7 with an opening at the fourth edge 10. For purpose of illustration only, the lower left corner of first panel 5 is shown removed in phantom so that second panel 6 is visible. There is a zipper-type closure 4 shown schematically at the opening.

Figure 2:
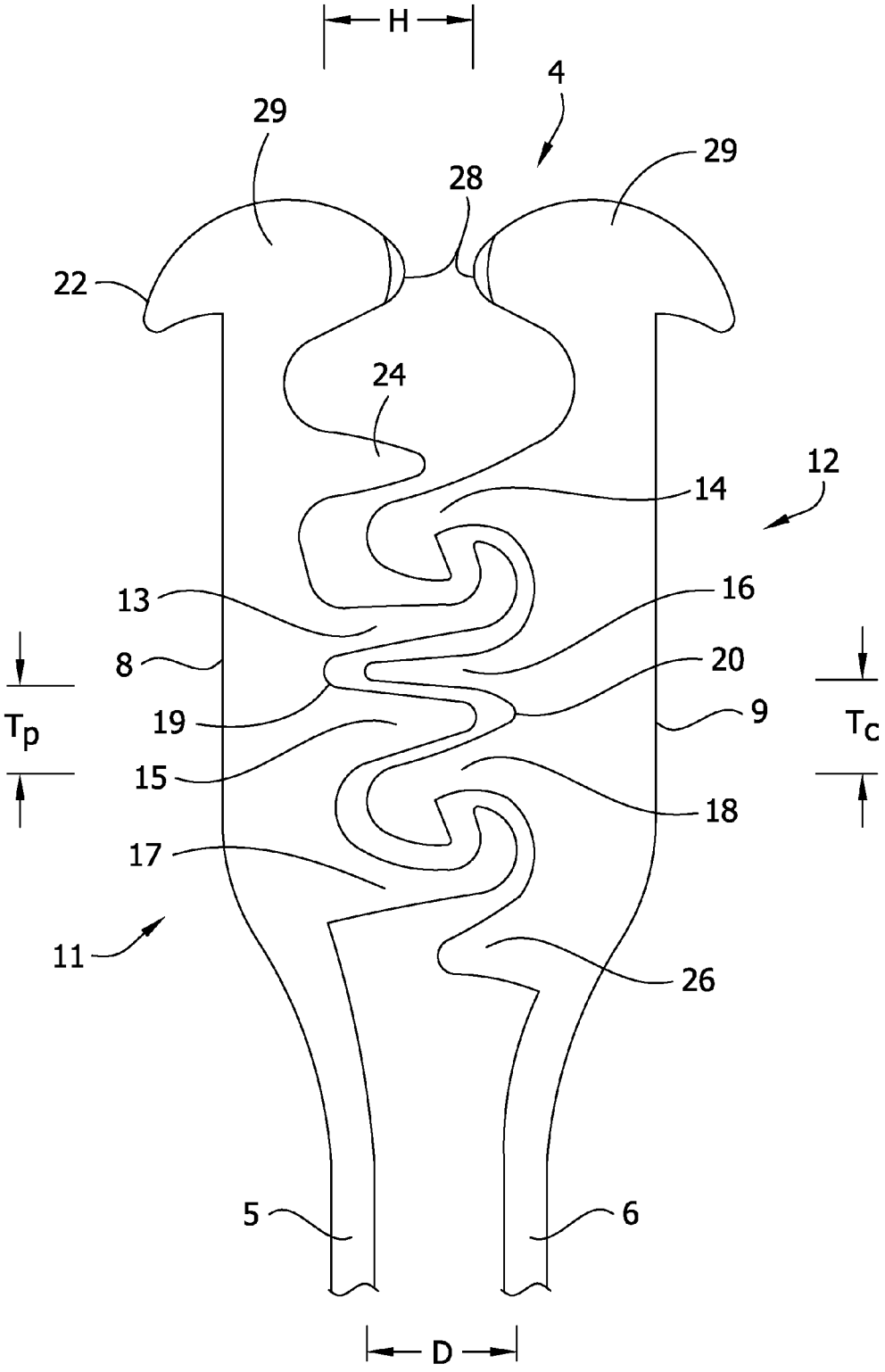
FIG. 2 is an elevation of a closure for being appended to the bag.

In one preferred embodiment, the closure 4 comprises first and second mutually interlocking profiles designated 11 and 12 in FIG. 2, which is an end view of the closure. These are appended to the first and second panels, respectively. The interlocking profiles 11, 12 comprise a first profile vertical sidewall 8 and a second profile vertical sidewall 9. There are multiple projections 13, 15, and 17 extending laterally from the first profile sidewall 8 toward the second profile sidewall 9 and multiple projections 14, 16, and 18 extending laterally from the second profile sidewall toward the first profile sidewall. The multiple projections comprise a first closure projection 13 on the first interlocking profile 11 which interlocks with a first closure projection 14 on the second interlocking profile 12 when the closure is engaged. There is a sealing projection 15 on the first interlocking profile 11 opposite a sealing channel 20 on the second interlocking profile 12, and a sealing projection 16 on the second interlocking profile 12 opposite a sealing channel 19 on the interlocking profile 11. There is also a second closure projection 17 on the first interlocking profile 11 which interlocks with a second closure projection 18 on the second interlocking profile 12 when the closure is engaged. Here there are illustrated four closure projections (13, 14, 17, 18) and two sealing projections (15, 16); but this arrangement is not narrowly critical. FIG. 2 also shows that closure 4 in the illustrated embodiment has guide members 24 and 26.

Figure 3:
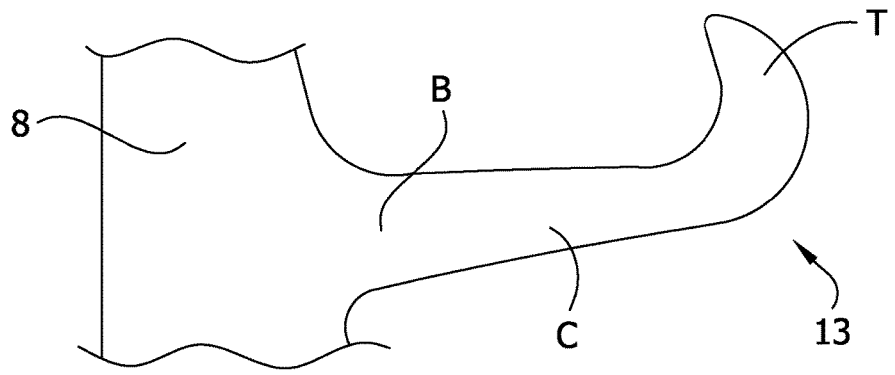
FIG. 3 is an enlarged fragmentary view of a portion of FIG. 2.
Figure 4:
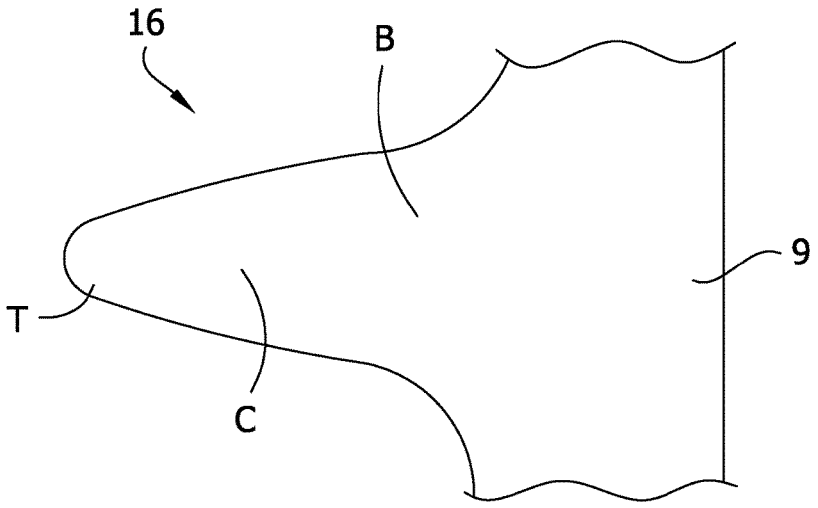
FIG. 4 is an enlarged fragmentary view of another portion of FIG. 2.

Each projection 13-18 comprises a base portion abutting the sidewall from which it projects, a central body portion, and a tip portion. This is illustrated in FIG. 3 which for closure projection 13 shows base portion B abutting sidewall 8, central body portion C, and tip portion T. This is illustrated in FIG. 4 which for sealing projection 16 shows base portion B abutting sidewall 9, central body portion C, and tip portion T. At least one of the sealing or closure projections is extruded from a plastic material which is different from and softer than a plastic material from which the other projections are extruded. One, two, three, or more of these projections in alternative embodiments may be extruded from a plastic material which is different from and softer than a plastic material from which the other projections are extruded. In one embodiment, for example, sealing projections 15 and 16 are extruded from a plastic material which is different from and softer than the plastic material from which the other projections are extruded. In another embodiment, sealing projections 15 and 16 as well as closure projections 17 and 18 are extruded from a plastic material which is different from and softer than the plastic material from which the other projections are extruded. In an alternative embodiment, opposing projections are of the differing materials. For example, in one such version, one of closure projections 13 and 14 is of the softer material and the other is of the more rigid material. Similarly in a different embodiment, one of projections 17 or 18 is of the softer material and the other is of the more rigid material. Or in another embodiment, one of the projections 13 or 14 and one of the projections 17 or 18 is of the softer material and the other two are of the more rigid material. When the closure 4 is used in combination with a slider as discussed below, it is preferable for at least the upper projections 13, 14 to be made from a more rigid material.

In certain embodiments the zipper profile sidewalls 8, 9 are extruded from the same hard material that forms the harder ones of the projections. In these embodiments, the softer projections are coextruded with the harder projections and sidewalls 8, 9 such that, for example, the base portion B, central body portion C, and tip portion T comprise the softer material and the edge of the base portion B defines a boundary between the softer material of the projection and the harder material of the sidewall from which it extends. In other embodiments, the softer projections can be coextruded so that only the tip portion T or tip portion and central body portion C are formed from the softer material. In certain embodiments, a portion of one or both of the sidewalls 8, 9 (e.g., a lower portion) is coextruded from the softer material along with the softer projection(s) (e.g., one or more lower projections). For example, referring to FIG. 2, in one embodiment, the sealing projections 15, 16 and lower closure projections 17, 18 comprise a softer material, and the lower portion of the sidewalls 8, 9 from which the soft projections extend are extruded from the same softer material. The sidewalls 8, 9 can also be formed from a different material than any of the projections without departing from the scope of the invention.

With respect to these two materials, the softer material from which the selected projections are manufactured is, for example, an elastomeric polymeric-based material such as, for example, Affinity, Engage and Versify by Dow, Exact, Vistamax, Escorene by ExxonMobile, or blends of the such polymers with LDPE, LLDPE, HDPE or PP. The more rigid material from which the other projections are manufactured are selected from, for example, LDPE, LLDPE, HDPE or PP. In preferred embodiments, the softer material has Shore D hardness less than about 45, such as between about 10 and about 45. In such embodiments, the Shore D hardness of the more rigid material is greater than about 45, such as between about 45 and about 85. The bag panels 5, 6 can be made from any suitable material including LDPE and LLDPE or another polyolefin such as HDPE, PP, etc.

The present invention therefore uses a softer plastic material for certain components of the closure than for other components of the closure. In contrast to prior designs which employ only a relatively rigid plastic for the entire closure, the arrangement of the present invention helps form a hermetic seal. These softer components in the new design are not configured to have close, tight-fitting tolerances (e.g., in certain embodiments, a sealing projection 15 (FIG. 2) comprising a relatively soft material is not configured to be received in a close tolerance fit in the channel 20), as such tolerances and precise dimensions are especially difficult to reliably and consistently co-extrude. Rather, the softer, more flexible components in at least one design of the invention merely touch against each other to form a seal. Referring again to FIG. 2, when, for example, the sealing projections 15, 16 are formed of a softer material than the other projections, the closure is configured to create multiple potential points of sealing contact (i.e., the sealing projection 16 can sealingly contact one or both of the projections 13, 15, and the projection 15 can sealingly contact one or both of the projections 16, 18) and therefore overcome the dimensional variation limitations with standard production. For example, if due to standard co-extrusion inconsistencies, one projection is slightly higher, thicker, or longer such that it does not precisely mate up with its counterpart, the softer material and design permit more displacement without interfering with the zipper closure or seal.

FIG. 2 illustrates one example of how the projections of a closure profile can be sized for sealing contact without being sized for a close tolerance fit. In FIG. 2, the sealing projection 15 has a height H and the base of the sealing projection 15 has a thickness Tp. The channel 20, which is configured to sealingly receive the sealing projection 15, has a depth D and the mouth of the channel 20 has a thickness Tc. The base portion B of the projection 15 and mouth portion of the channel 20 can be modeled as having approximately isosceles triangular shapes for purposes of evaluating sealing contact between the projection and channel under ideal manufacturing conditions.

In one or more embodiments, the thickness Tp of the projection 15 is at least as great as the thickness Tc of the channel 20 when the closure 4 is manufactured according to one preferred embodiment. For example, in one or more embodiments, the preferred ratio of Tp/Tc is from about 1.0 to about 1.5 or, preferably, from about 1.04 to about 1.35. Under preferred manufacturing conditions, a base portion B of the projection 15 is shaped and arranged to engage the channel 20 at two points of sealing contact—the top and bottom surfaces of the projection sealingly engage the top and bottom walls of the channel, respectively—when the closure 4 is closed. In certain embodiments, the height H of the projection 15 is greater than or equal to the ideal depth D of the channel. The tip T of the sealing projection 15 is shaped and arranged to sealingly engage the base of the channel 20 along one point of sealing contact when the closure 4 is closed. In some embodiments, the central portion C of the sealing projection 15 is manufactured to be slightly spaced apart from the channel walls when the closure 4 is closed. When these embodiments are manufactured to achieve preferred specifications, the projection 15 sealingly engages the channel 20 at three points: the tip portion T engages the base portion of the channel; the top surface of the base portion B engages the top wall of the mouth portion of the channel; and the bottom surface of the base portion engages the bottom wall of the mouth of the channel. But sealing engagement at any one of these three points of contact could be sufficient to seal the bag opening 10.

Using this manufacturing geometry, it can be seen that a sealing projection 15 and channel 20 manufactured within a wide range of tolerance will provide a seal over the bag opening 10 when the closure 4 is closed. For example, assuming the projection 15 and channel 20 have cross-sectional shapes that can be modeled as isosceles triangles, if the projection 15 is ideally manufactured to have a base thickness Tp that is equal to 1.3-times the mouth thickness Tc of the channel 20, the top and bottom surfaces of the projection will sealingly engage the top and bottom walls of the channel when only about 77% of the projection height H is received in the channel. Even when manufacturing variance causes vertical misalignment of the projection 15 and channel 20 there will generally be at least one point of sealing contact between the top surface of the projection and top wall of the channel or bottom surface of the projection and bottom wall of the channel. Even if the projection 15 is manufactured too thinly or the channel 20 too thickly, the projection will sealingly engage the channel when a greater percentage of its height H is received in the channel. Likewise, when the projection 15 is manufactured to have a greater height H than the depth of the channel 20, the tip T of the projection will sealingly engage the base of the channel before the full height of the projection is received in the channel. If, due to manufacturing variance, the projection 15 is too short or the channel 20 is too deep, the tip T of the projection will still sealingly engage the base of the channel when a greater portion of the height H of the projection is received in the channel. If the projection 15 is far shorter than the channel 20, there are still two potential points of sealing contact between the top and bottom surfaces of the base portion B of the projection and top and bottom walls of the mouth portion of the channel. Thus, the preferred geometry of the closure 4 preferably creates multiple points of sealing contact between the projection 15 and the channel 20 so that the projection sealingly engages the channel even when manufacturing variance occurs.

It will be understood that, in the discussion above, the term "point" of sealing contact refers an area of engagement of the zipper profiles at one location along the width of the closure 4. To form a seal over the bag opening 10, a line of sealing contact should extend from the point continuously along the width of the closure 4 between the opposite sides 7 of the bag.

Figure 5:
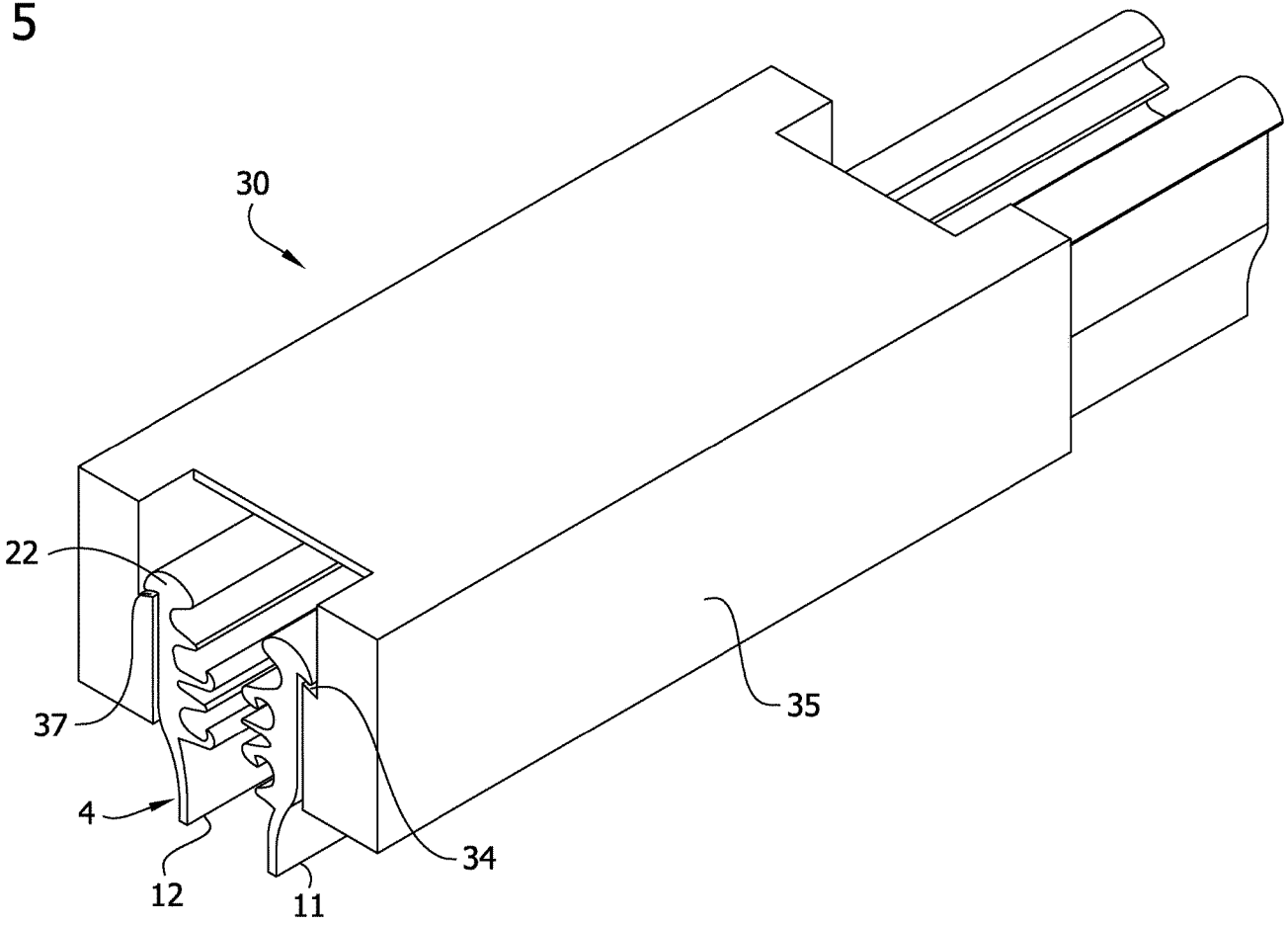
FIG. 5 is a perspective of the closure with a slider mounted thereon.
Figure 6:
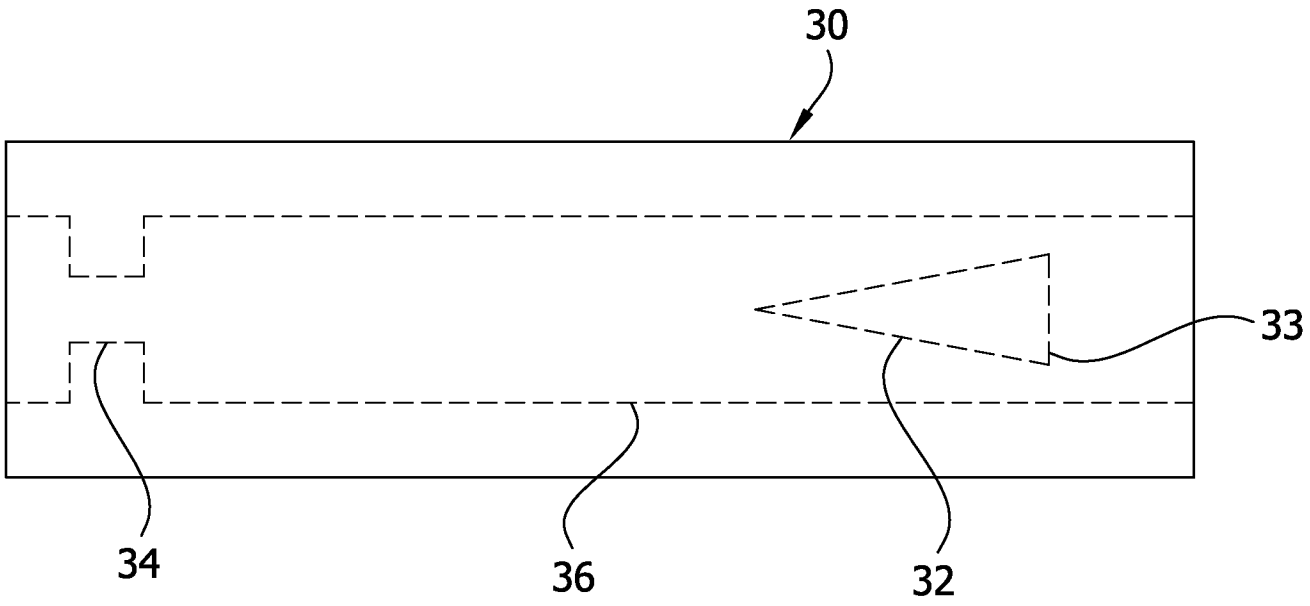
FIG. 6 is a top plan view of the slider illustrating internal features thereof in phantom.
Figure 7:
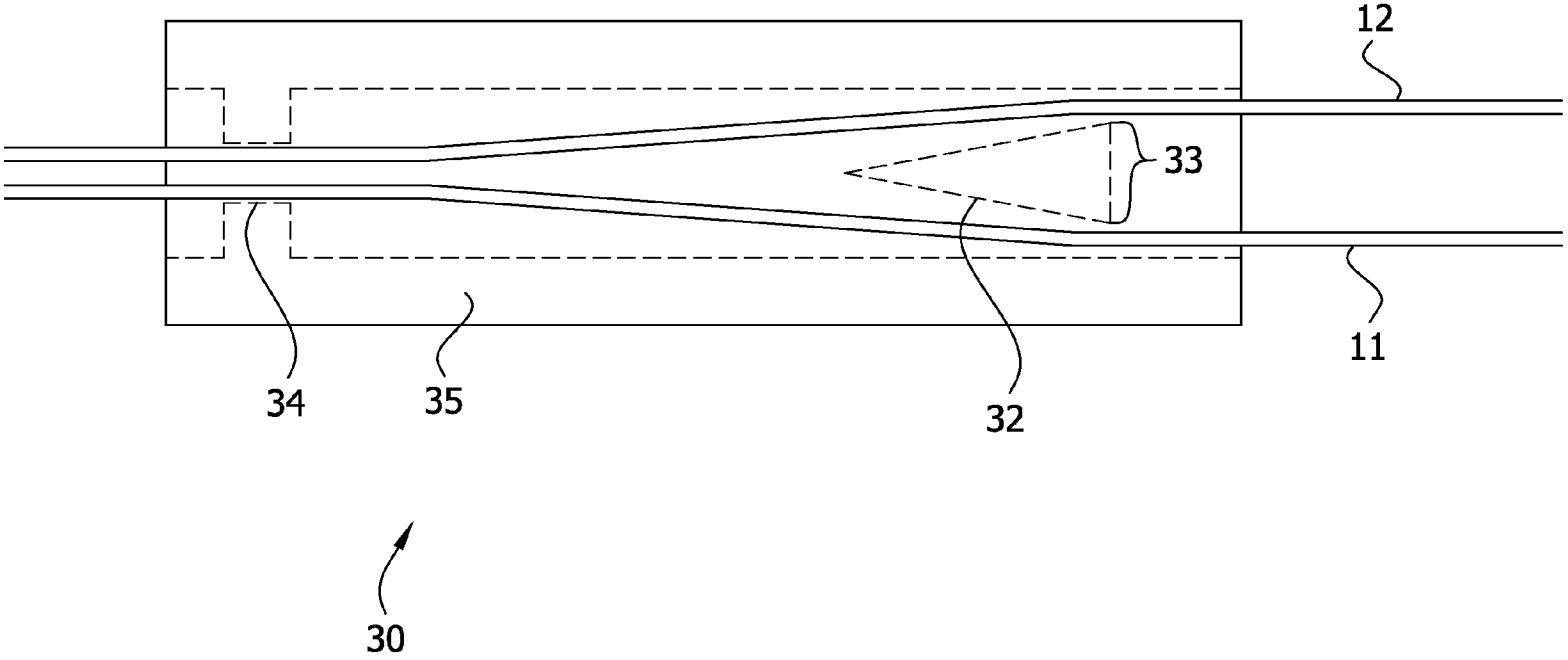
FIG. 7 is like FIG. 6 and illustrates the closure passing through the slider.
Figure 8:
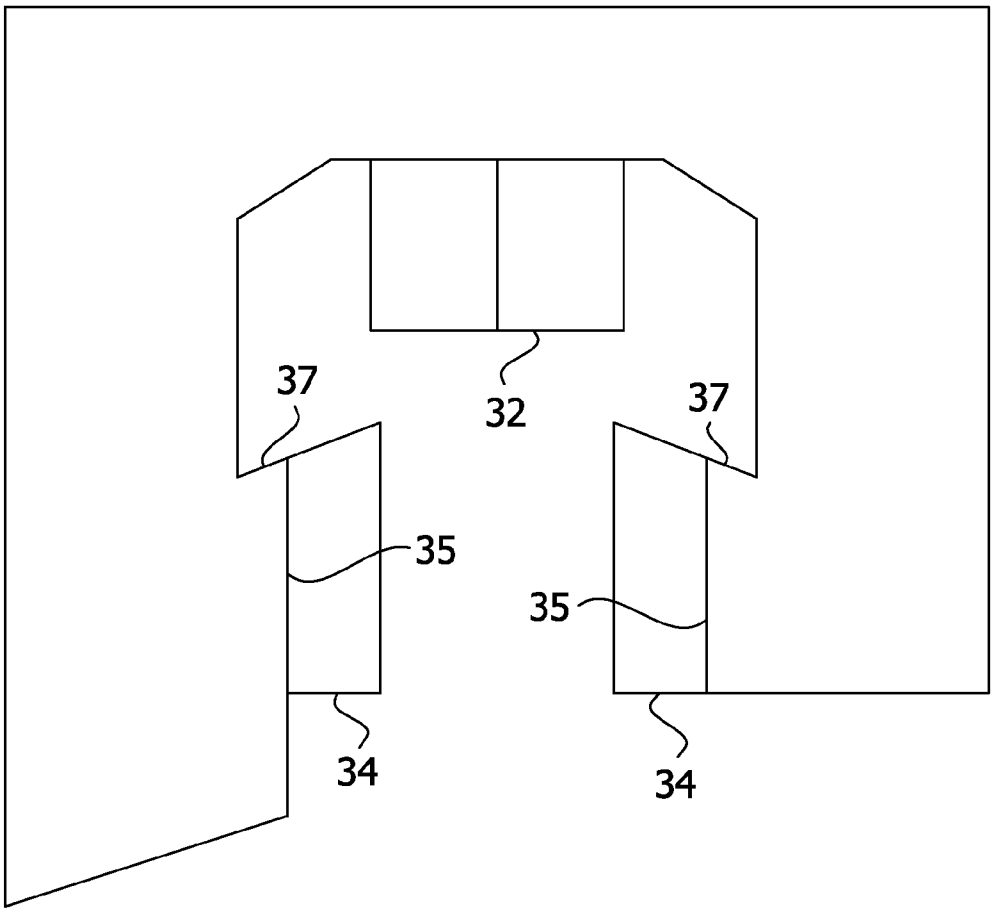
FIG. 8 is an end elevation of the slider.
Figure 9:
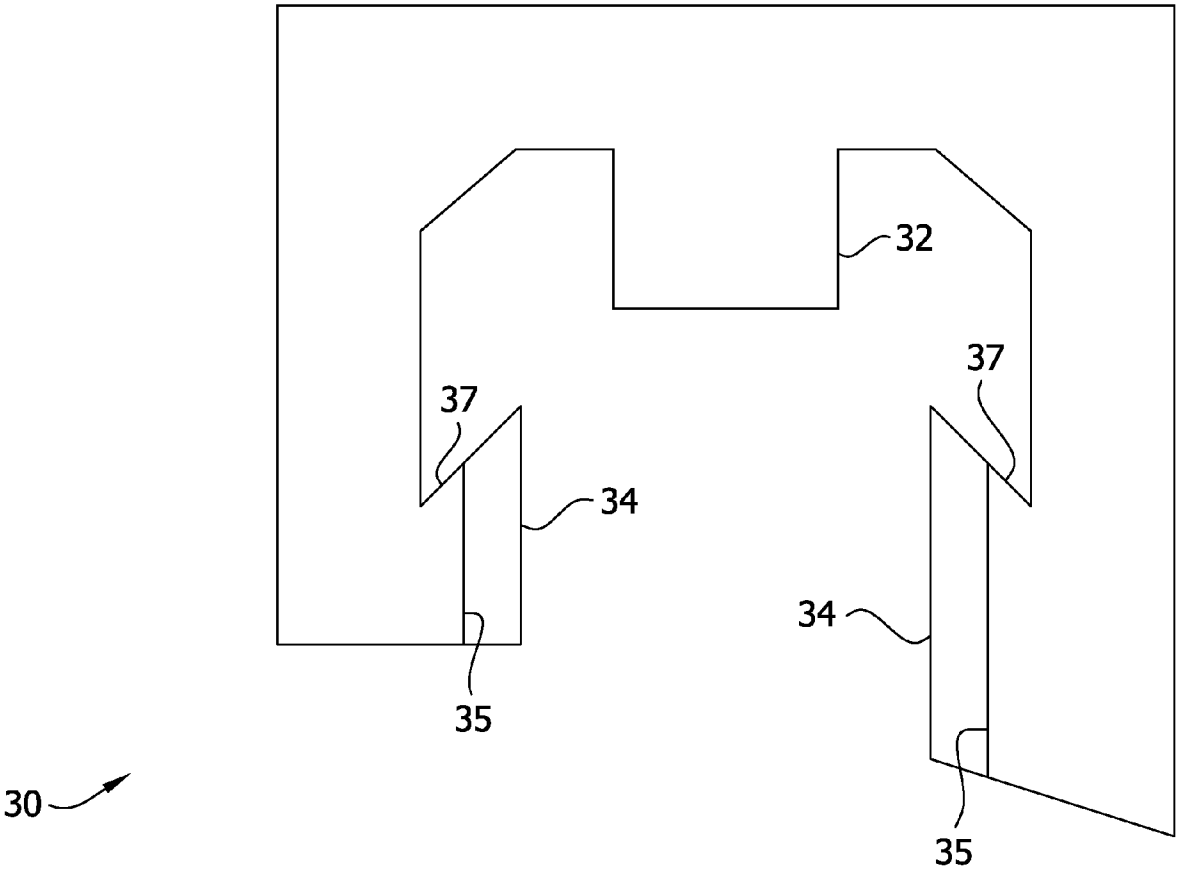
FIG. 9 is an end elevation of the slider from the opposite vantage as FIG. 8.

In one or more embodiments, the closure 4 is used in combination with a slider 30. FIG. 5 is a perspective view of slider 30 on closure 4. As shown in the top view in FIG. 6, the slider has a separator or opener at 32 in the shape of a wedge and a constrictor or closer at 34. The top view in FIG. 7 shows how the closure 4 is situated within the slider 30. FIG. 9 is an end view showing the walls 35 and edges 37 which hold the slider 30 on the rail 22 (See FIG. 5) of the closure 4. The separator 32 pushes the shoulder 29 to unlock the closure projections 13, 14 and 17, 18 to open the zipper. The walls 35 assist the constrictor 34 to push the closure profile closed. The slider 30 preferably has a shape, such as having differing wall lengths, that allows it to be machine-sorted and machine-aligned in the proper direction during assembly. The constriction 34 illustrated, for example, in FIG. 6 extends inward from the walls 35 to define a narrower space than the walls for closing the closure 4.

In one embodiment, the closure also includes alternating deformed and undeformed segments at 28 on the shoulders 29 (FIG. 2). So when the slider 30 is moving, the two bottom corners 33 of the wide end separator 32 (FIG. 7) are in touch with alternating deformed and undeformed segments at 28 on the shoulders 29 to generate a clicking sound and feel, i.e., audible and tactile feedback about the opening and closing of the zipper.

With respect to rails 22 shown in FIG. 2, in one aspect the preferred embodiment of the invention has these rails positioned up with the shoulders as shown (e.g., at the top edge margin of the closure 4). This is conspicuously in contrast to the conventional arrangement as shown in FIG. 3 of US 2013/0287322, where the rails 312*a* and 312*b* are at the bottom of the closure. This permits the height of the slider 30 to be greatly reduced, and less material is needed for the slider 30.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

The invention claimed is:

1. A plastic bag comprising:

a first panel;

a second panel, the first panel and second panel defining a bag interior and an opening at an end margin of the first and second panels to permit access to the bag interior; and a closure at the opening comprising first and second mutually interlocking profiles on the first and second panels, respectively, the interlocking profiles comprising;

a first profile vertical sidewall and a second profile vertical sidewall;

multiple projections extending laterally from the first profile sidewall toward the second profile vertical sidewall and multiple projections extending laterally from the second profile sidewall toward the first profile sidewall, the multiple projections comprising:

a hook-shaped first closure projection on the first interlocking profile which interlocks with a hook-shaped first closure projection on the second interlocking profile when the closure is engaged;

a sealing projection on the first interlocking profile opposite a sealing channel on the second interlocking profile, and a sealing projection on the second interlocking profile opposite a sealing channel on the first interlocking profile; and a second closure projection on the first interlocking profile which interlocks with a second closure projection on the second interlocking profile when the closure is engaged;

wherein each of the multiple projections consists of a base portion abutting the sidewall from which it projects, a central body portion, and a tip portion; and wherein for the sealing projection on the first interlocking profile and exactly one of either the first closure projection or the second closure projection on the first interlocking profile, the base portion abutting the sidewall from which it projects, the central body portion, and the tip portion constituting the entirety of the sealing projection on the first interlocking profile and the exactly one of either the first closure projection or the second closure projection on the first interlocking profile are extruded from a plastic material which is different from and softer than a more rigid plastic material from which all of the other projections on the first and second interlocking profiles are extruded, such that the sealing projection on the first interlocking profile and the exactly one of either the first closure projection or the second closure projection on the first interlocking profile consist of the softer material.

2. The plastic bag of claim 1 wherein the sealing projection is spaced apart between the first and second closure projections on each of the first and second interlocking profiles.

3. The plastic bag of claim 2 wherein the sealing projection and the first closure projection on the first interlocking profile define the sealing channel on the first interlocking profile.

4. The plastic bag of claim 3 wherein the sealing projection on the second interlocking profile is sized and arranged for being received in the sealing channel on the first interlocking profile in a non-close tolerance fit and to touch against one of the sealing projection and the first closure projection on the first interlocking profile to seal the bag opening.

5. The plastic bag of claim 4 wherein the sealing projection and second closure projection on the second interlocking profile define the sealing channel on the second interlocking profile.

6. The plastic bag of claim 5 wherein the sealing projection on the first interlocking profile is sized and arranged for being received in the sealing channel on the second interlocking profile in a non-close tolerance fit and to touch against one of the sealing projection and the second closure projection on the second interlocking profile to seal the bag opening.

7. The plastic bag of claim 1 wherein the exactly one of either the first closure projection or the second closure projection on the first interlocking profile having the base portion, the central body portion, and the tip portion extruded from the softer material is located closer to the first and second panels than are the sealing projections and the sealing channels.

8. The plastic bag of claim 1 wherein the softer material comprises a material selected from an elastomer-based material or an elastomer-based material in a blend with one or more of LDPE, LLDPE, HDPE, and PP, optionally in combination with other additives.

9. The plastic bag of claim 1 wherein the more rigid plastic material from which all of the other projections on the first and second interlocking profiles are extruded comprises a material selected from the group consisting of one or more of LDPE, LLDPE, HDPE, and PP, optionally in combination with other additives.

10. The plastic bag of claim 1 wherein each of the first and second interlocking profiles comprises a top edge margin which defines the bag opening when the closure is open and a bottom edge margin which is joined to one of the first and second panels, respectively, each of the first closure projections being located near the top edge margin, each of the second closure projections being located near the bottom edge margin, and each of the sealing projections being spaced apart between the first and second closure projections of the respective interlocking profile.

11. The plastic bag of claim 10 further comprising a slider mounted on the first and second interlocking profiles for selectively sliding along the closure to selectively open and close the bag.

12. The plastic bag of claim 11 wherein the first and second interlocking profiles each comprise a rail extending outward from the respective profile sidewall at the top edge margin thereof for slidably mounting the slider on the bag.

13. The plastic bag of claim 12 wherein the first and second interlocking profiles each comprise a shoulder extending inward opposite the rail from the respective profile sidewall and the slider comprises a spreader received between the top edge margins of the interlocking profiles and engaging the shoulders thereof.

14. The plastic bag of claim 13 wherein the shoulders of the first and second interlocking profiles define deformations configured to impart audible and/or tactile feedback on the slider as the slider slides along the closure in at least one of an opening and a closing direction.

15. The plastic bag of claim 1 further comprising deformations which impart audible and/or tactile feedback properties to the closure.

* * * * *